US005829086A

United States Patent [19]

Billek

[11] Patent Number: 5,829,086

[45] Date of Patent: Nov. 3, 1998

[54] PORTABLE GOLF BALL CLEANER

[76] Inventor: Eugene Billek, 5657B Harpers Farm Rd., Columbia, Md. 21044

[21] Appl. No.: 829,311

[22] Filed: Mar. 31, 1997

Related U.S. Application Data

[63] Continuation-in-part of Ser. No. 597,290, May 15, 1996, abandoned.

[51] Int. Cl.[6] ..... A63B 47/04

[52] U.S. Cl. ..... 15/21.2; 15/104.92; 15/160

[58] Field of Search ..... 15/3, 94, 96, 21.2, 15/104.92, 160

[56] References Cited

U.S. PATENT DOCUMENTS

| | | | |
|---|---|---|---|
| 3,044,089 | 7/1962 | Boyton | 15/21.2 |
| 3,271,802 | 9/1966 | Thompson | 15/160 |
| 5,572,761 | 11/1996 | Meyer | 15/160 |
| 5,647,082 | 7/1997 | Garske | 15/160 |

FOREIGN PATENT DOCUMENTS

| | | | |
|---|---|---|---|
| 0012853 | 9/1908 | United Kingdom | 15/21.2 |

*Primary Examiner*—Randall E. Chin
*Attorney, Agent, or Firm*—Peter Gibson

[57] ABSTRACT

A container constructed of an outer liquid impermeable shell with an open mouth and a liquid permeable chamber rigidly dependent from the anterior of a lid to the outer shell provides a sealed closure of the outer shell with the permeable chamber entirely enclosed interior to the closed container. The permeable chamber is configured to receive a golf ball toward the top, proximate the anterior of the lid, and allow displacement of the golf ball in the interior of the chamber to the bottom of the same after sealing the container with the lid, immersing the golf ball in cleansing fluid held in the impermeable shell. Reciprocal displacement of the contained golf ball with reciprocation of the closed container in an appropriate amount of cleansing fluid wets and brings the exterior surface of the ball into contact with scrubbing surfaces disposed upon the interior of the permeable chamber thus cleaning the ball. The container may be constructed with an overall diameter only fractionally greater than the diameter of a standard golf ball and a length of about three diameters of a golf ball. The golf ball is quickly and efficiently cleaned, is quickly and easily placed into the container with unfastening of the lid and partial removal of the interior permeable chamber, and is quickly and easily retrieved from the container with unfastening of the lid, removal of the dependent chamber, and inversion of the same.

20 Claims, 4 Drawing Sheets

24

12
22
14
13
11
20
17
18
15
21
10
16

PORTABLE GOLF BALL CLEANER

This is a continuation-in-part of application Ser. No. 08/597,290 filed May 15, 1996 which is hereby expressly abandoned.

BACKGROUND OF THE INVENTION

Field of the Invention

The present invention relates generally to the field of cleaning by scrubbing, particularly to cleaning golf balls by scrubbing and specifically to portable containers for the same.

General Background

Golfing is a very popular sport in the United States with millions of enthusiasts. As with other golfing equipment, modern golf balls are considered rather sophisticated technically, possessing an exterior surface which is dimpled entirely with small concavities which impart aerodynamic lift to the ball in flight. If the exterior surface of the ball is dirty and any of these concavities are clogged with dirt or other material the ball will not possess optimum flight characteristics. A dirty ball does not possess the aerodynamic lift of a clean ball and is far less likely to maintain the desired course in flight than a clean one. Because the game of golf requires long and accurate shots involving flight of the ball the condition of the ball is considered crucial to playing the game of golf.

Stationary golf ball washers provided upon the courses are a commonplace. However, these washers are often poorly maintained, dirty, empty of fluid, particularly in cold weather, and often simply absent. Stationary golf ball washers are, by definition, available only upon the locations given by the particular golfing facility concerned. In other words, one cannot, no matter how well the stationary golf ball washers at a given golfing facility are maintained, clean a golf ball whenever and wherever one desires while golfing. It is also considered that clean golf balls are easier to find during play and are aesthetically pleasing. Having to play a dirty golf ball for lack of a convenient golf ball washer is detrimental to the aerodynamics of the ball in flight and, in knowing this, can cause frustration, lack of concentration and poor play in result. For all of these reasons, it is considered that while golfing, the ability to clean a golf ball whenever and wherever desired is a valuable one to a golfer.

Discussion of the Prior Art

As mentioned above, stationary golf ball washers are well known. U.S. Pat. No. 3,949,443 issued to Edgar discloses such a cleaner which uses an electric motor to rotate a drum in contact with a lower bath and lined scouring brushes to clean a plurality of golf balls placed therein. An examples of golf ball cleaner which is intended to be portable but which is considered rather bulky and inconvenient for portable use is found in U.S. Pat. No. 3,044,089 issued to Boynton which uses a perforated drum lined interiorly with brushes located within hinged, sealable, exterior container to clean the ball by rotating the drum in partial immersion in an appropriate fluid. A spring loaded shaft extending upward through the lid of the exterior container is reciprocated upward and downward to effect rotation of the drum clockwise and counterclockwise. The interior drum has a lid with a notched anterior fitting a notched rim of the lower portion of the drum so that the drum will remain closed during rotation of the same.

U.S. Pat. No. 3,221,355 issued to Grommes discloses a portable golf ball cleaner which uses inward facing bristles attached to the interior sidewall of a container into which golf balls are placed and cleaned after closure of the container with a cap which is semi-spherical and in which the ball is positioned by a "continuous circumferential row of stiff retaining tufts 14 sufficiently rigid to retain the ball in the position" (Column 2, lines 47–49) at the end of cleaning so that the cap, with ball held inside, may be removed in a relatively dry state without emptying the container of fluid. This reference is considered to constitute the most pertinent known to the disclosure of the present invention.

Other references pertaining to cleaning devices for golf balls are: U.S. Pat. Nos. 3,271,802, 3,806,983, 4,439,884, 4,473,917, 4,965,906, 5,081,735, France #643,018, Great Britain 1908 #12,853 and 1915 #7,955.

Statement of Need

U.S. Pat. No. 3,221,355 issued to Grommes, considered the most pertinent to the present invention, discloses a conveniently compact golf ball washer, as opposed to the rather bulky device disclosed by Boynton in U.S. Pat. No. 3,044,089, which is inherently efficient in cleaning a golf ball with manual reciprocal displacement of the closed container with a golf ball inside. And a golf ball is considered to be readily disposed in the container for cleaning. However, the method of removing the golf ball utilizing a semi-spherical cap associated with a ring of "stiff retaining tufts" is considered problematic.

The action achieving removal of the golf ball from the cleaner disclosed by Grommes remains rather elusive: "(w)ith the ball in this position, the cap may be removed and the ball easily retrieved from the cleaner." (column 2, lines 66–68) It is also noted that "the cap has interior dimensions slightly greater than a golf ball so as to loosely confine the ball when it rests on the stiff tufts 14 with about 1/16" clearance between the ball and the top of the cap." (Column 2, lines 59–63) It seems that a majority of the ball must be within the elevation of the cap and pressure through the cap about the periphery of the same must be exerted upon the underside of the ball enclosed in order to remove the ball from the container in the cap, which requires deformation of the periphery of the cap, or the container, in an open state, must be inclined to allow the golf ball to be retained by gravity in the cap during retrieval. In either case the ball must be manipulated in a loose state in balance between the retaining ring of the container and the cap detached from the same. In the first case a flexible cap is required in order to cup the periphery of the cap below the equator of the ball. This action is considered eventually to cause distortion and fracture of the cap periphery which will impair the seal effected by the cap. The second case is considered to invite spillage of cleaning fluid from the container. It is also considered that the retaining tufts or equivalent must wear and the positioning of the ball by the same will suffer as a result of use.

Because of these shortcomings resulting from the inherent difficulties involved in using a semi-spherical cap as discussed above, it is considered that there exists a need for a convenient, portable, device for cleaning a golf ball into which a golf ball is quickly and easily disposed, cleaned, and retrieved from the same without balancing of ball between the container and a cap and without damaging deformation of the device resulting from use and further avoiding spillage of cleaning fluid content in operation.

SUMMARY OF THE INVENTION

Objects of the Invention

The encompassing object of the principles relating to the present invention is the provision of a convenient, portable, golf ball cleaner which is effective, quick and easy to use and which allows retrieval of the ball without spillage of cleaning fluid and without damaging deformation of any portion of the device.

An auxiliary object of the principles relating to the present invention is the provision of such a convenient, portable, golf ball cleaner which is effective, quick and easy to use which allows retrieval of the ball without spillage of cleaning fluid and without damaging deformation of any portion of the device which is substantially unaffected either physically or in effectiveness in cleaning with repeated use over time.

Another auxiliary object of the principles relating to the present invention is the provision of such a convenient, portable, golf ball cleaner which is effective, quick and easy to use which allows retrieval of the ball without spillage of cleaning fluid and without damaging deformation of any portion of the device which is constructed with a minimum of separate components.

An ancillary object of the principles relating to the present invention is the provision of such a convenient, portable, golf ball cleaner which is effective, quick and easy to use which allows retrieval of the ball without spillage of cleaning fluid and without damaging deformation of any portion of the device which thoroughly cleans a golf ball including the concavities forming the dimpled exterior of a golf ball.

Another ancillary object of the principles relating to the present invention is the provision of such a convenient, portable, golf ball cleaner which is effective, quick and easy to use which allows retrieval of the ball without spillage of cleaning fluid and without damaging deformation of any portion of the device which may be readily attached to a typical golf bag.

Other ancillary objects of the principles relating to the present invention include minimization of: the size of the device, the weight of the device, and the cost of the device in manufacture.

Principles Relating to the Present Invention

A device in accordance with the principles relating to the present invention constitutes a container comprised essentially of only two separate parts: (1) a liquid impermeable shell with an open mouth and; (2) a combined lid and fluid permeable interior receptacle. The lid effects a liquid tight seal of the mouth and disposes the receptacle interior to the container in this closed state. The interior of the receptacle comprises a scrubbing chamber having an effective diameter sufficient to allow displacement of a standard golf ball in a rolling motion a distance substantially as great as half the circumference of the ball, i.e. about two and a half inches, in order to ensure thorough cleansing and preferably a distance substantially as great as a full circumference, i.e. about five inches, or more, but preferably less than three circumferences, i.e. about seven inches, this last preference being for compactness of the overall device.

The scrubbing chamber possesses means of scrubbing the exterior surface of a golf ball reciprocally displaced within the chamber. A sufficient number of groups of bristles projecting from the interior surface of the interior receptacle is considered a satisfactory scrubbing means as is a sufficient surface area covered by interiorly facing flexible blades such as the material used for synthetic grass on playing fields. It is preferred, however, for reasons of economy and resistance to wear, that the scrubbing means be comprised of interiorly projecting edges of a wall defining the chamber. Several methods are recommended for obtaining these interiorly projecting edges: puncturing the wall such that fracturing occurs; perforation of the wall such that ridges are formed facing inward; and molding solid inward projections of the wall.

The interior receptacle when disposed interior to the fluid impermeable shell must allow fluid held in the shell entrance and egress into and from the scrubbing chamber. The interior receptacle must allow fluid in the outer shell to enter the chamber when the receptacle is disposed inside the outer shell and must allow emptying of the chamber of fluid in removal of the interior receptacle from the outer shell. This suggests that drainage through the bottom or the sidewall proximate the bottom of the interior receptacle be provided.

The combined lid and interior receptacle structure is preferably of one piece or attached to each other such that a single substantially rigid structure is obtained. This aspect, in combination with at least one aperture through interior receptacle proximate the top of the same but anterior to the lid of sufficient size to permit a standard golf ball therethrough permits loading of the scrubbing chamber with a golf ball and retrieval of the golf ball from the same without damaging deformation of any part of the device and without spillage of fluid held in the same. Loading is effected by simply pushing the ball through the aperture into the chamber, disposal of the interior receptacle partially within the outer shell and fastening of the lid. Retrieval is effected with unfastening of the lid and removal of the interior receptacle from the outer shell and inversion of the same.

Several types of fastenings of the lid to the outer shell in closure of the container are specifically recommended: screw, lug and snap. Screw closure is preferred, particularly utilizing a pipe type threading. The snap lid involves resilient deformation which is considered less reliable than threading in sealing and inferior for this reason. Another preferred aspect is inclusion of some means of removably attaching the device to a golf bag. A resilient clip comprises the preferred means of attachment.

Other preferred aspects and details concerning what is considered to be the best manner of making and using a device in accordance with the principles relating to the present invention may be readily appreciated in a reading of the detailed discussion of the preferred embodiments below made with reference to the drawings attached hereto.

DETAILED DESCRIPTION OF THE PREFERRED EMBODIMENTS

Figures 1A, 1B:
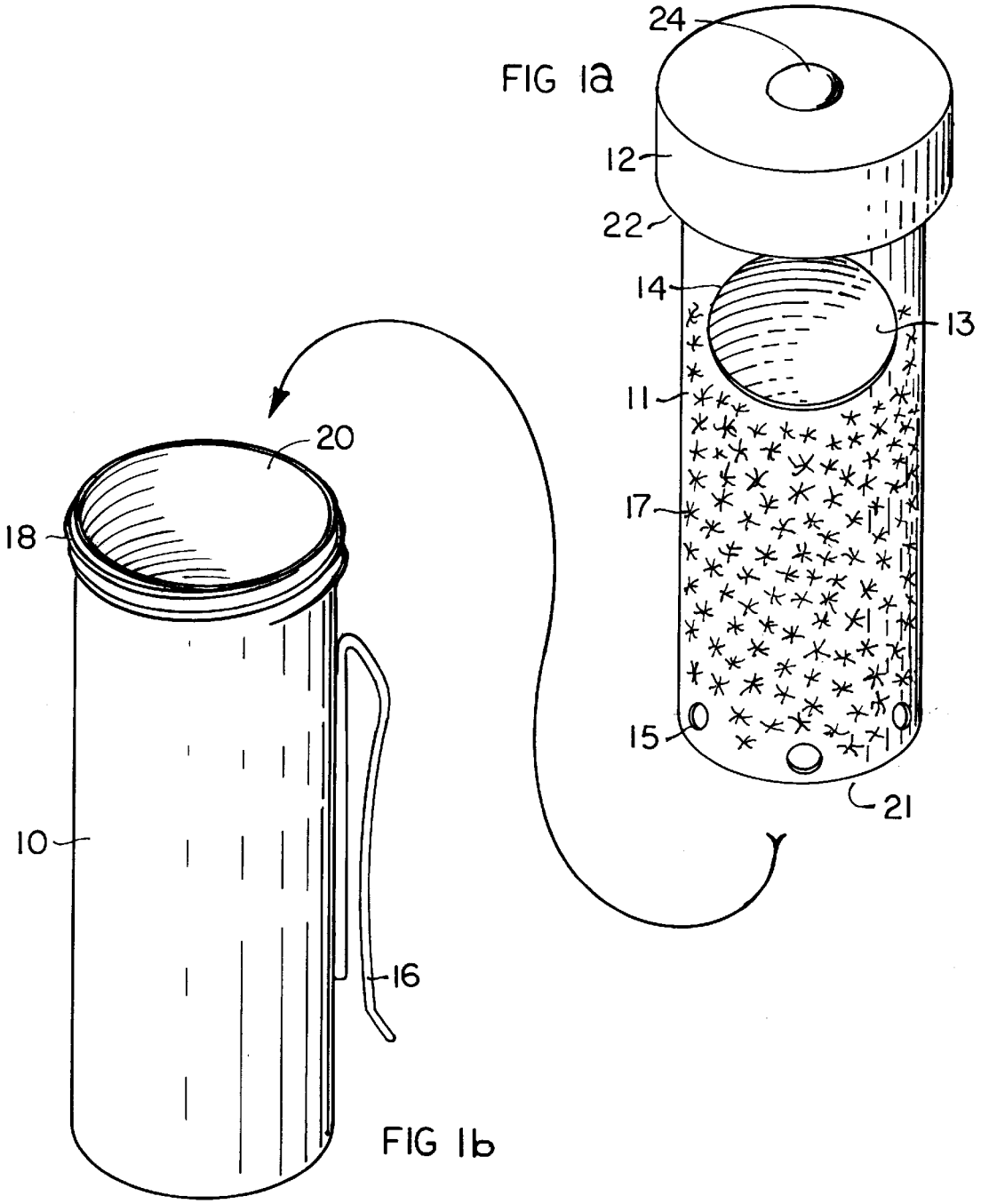
FIG. 1*a* is an isometric view of the outer shell of a first preferred embodiment of the principles relating to the present invention.
FIG. 1*b* is an isometric view of the interior receptacle and lid of a first preferred embodiment of the principles relating to the present invention.

FIGS. 1*a* & 1*b* depict a first preferred embodiment of the principles relating to the present invention which consists essentially of two components: a liquid impermeable open mouth container known hereinafter as an outer shell 10; and a liquid permeable container known hereinafter as the interior receptacle 11 which is rigidly dependent from a lid 12 which provides a removable sealing of the outer shell 10 with the interior receptacle 11 disposed inside. The interior receptacle 11 and the lid 12 operate as a single rigid structure in use and for this reason is considered to comprise, at this functional level, a single component separate from the outer shell 10. This does not mean that the interior receptacle 11 and the lid 12 must be comprised of a single piece. In the preferred embodiment depicted in FIG. 1*a* the lid 12 is comprised of a conventional screw on type threaded cover for the outer shell 10, which, in this embodiment, is relatively permanently attached to the interior receptacle 11 by a rivet 24.

Figure 2:
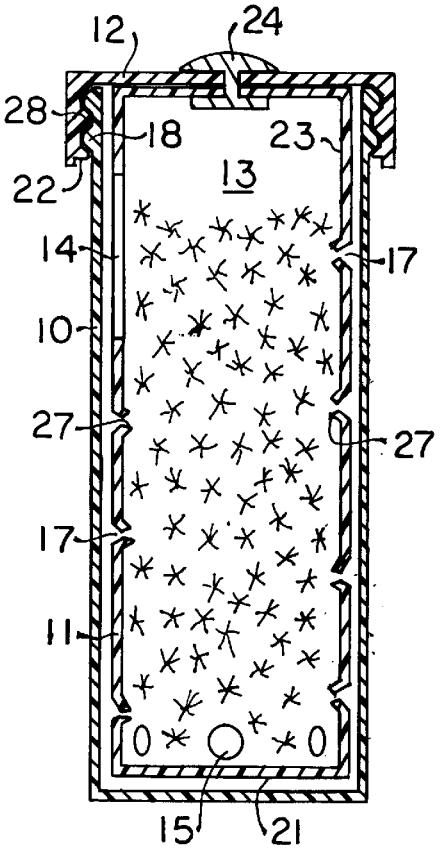
FIG. 2 is a cross sectional view of the assembled outer shell and interior receptacle and lid depicted in FIGS. 1*a* & 1*b*.

Hence the outer shell 10 and the lid 12 in this first preferred embodiment depicted in FIGS. 1*a*, 1*b*, & 2 may readily be comprised of a commonly available open mouth container with a threaded closure preferably providing a moisture or water proof seal. The outer shell 10 possesses a top opening 20 or mouth through which the interior receptacle 11, bottom 21 first, is passed through. This preferred embodiment further possesses a clip 16 constructed of suitably resilient material of dimensions and configuration suited to clipping upon the exposed upper edge of a typical golf bag or pocket upon the same. The interior receptacle 11 possesses a scrubbing chamber 13 into which a golf ball is readily disposed, in this case by use of a single upper aperture 14 of sufficient diameter to admit a standard golf ball, which is disposed toward the top of the interior receptacle 11, proximate the anterior 22 of the lid 12. The scrubbing chamber 13 is bounded by the interior surface 23 of the interior receptacle 11 which possesses projections directed inward that provide scrubbing means for a golf ball disposed therein.

In the portion of the first preferred embodiment depicted in FIG. 1*a* the scrubbing means is comprised of a plurality of inward fractures 17 of the cylindrical sidewall of the interior receptacle 11 each of which present broken edges 27 of the sidewall directed inward as seen in FIG. 2. These broken edges 27 of the sidewall of the interior receptacle 11 possess an effective diameter and project inward a degree commensurate with the diameter and depth of each of the concavities upon a modern golf ball possessing a dimpled surface. The interior receptacle 11 in this first preferred embodiment further possesses a plurality of drain holes 15 through the sidewall of the receptacle 11 proximate the bottom 21 of the same which is, in this case, solid.

FIG. 2 depicts, in cross section, the two parts of this first preferred embodiment of the principles relating to the present invention assembled together. The broken edges 27 of the inward fractures 17 are seen, as are the solid bottom 21 to the interior receptacle 11, the positioning of the upper aperture 14 proximate the anterior 22 of the lid 12 and the rivet 24 attachment of the top of the interior receptacle 11 to the lid 12. The female threading 28 of the lid 12 which mates with the male threading 18 about the upper perimeter bounding the top opening 20 of the outer shell 11 is also seen therein.

It is further seen in FIG. 2 that the outer shell 10 and the interior receptacle 11 are comprised of a substantially uniform thickness sidewall and bottom end wall describing the generally cylindrical shape of each depicted in FIGS. 1*a* & 1*b*, and that the clearance between the two is commensurate with the wall thickness of either structure. It is further noted that the substantially uniform diameter of the interior of the scrubbing chamber 13 is greater than the diameter of a golf ball by approximately the same dimension. All of these aspects are considered significant in obtaining a minimum exterior diameter of the assembled device and minimum overall size of the same.

It is further noted that construction of the combined interior receptacle 11 and lid 12 with a rivet 24 as seen is considered an economic means of facilitating the use of a conventional open mouth container with a threaded screw lid closure. In this case it is also suggested that the clip 16 be bonded to the exterior of the outer shell 10 by cement, ie. chemical means, or welding, ie. thermal means, to provide a relatively permanent attachment which is economic and facilitates use of purchased components. The use of a plurality of fractures 17 each presenting broken edges 27 projecting inward from the generally cylindrical interior surface 23 of the interior receptacle 11 avoids the use of another component to provide scrubbing means, allows minimization of the diameter required of the scrubbing chamber 13 and provides a means of scrubbing a golf ball disposed therein which is relatively impervious to wear resulting from use.

Figure 3:
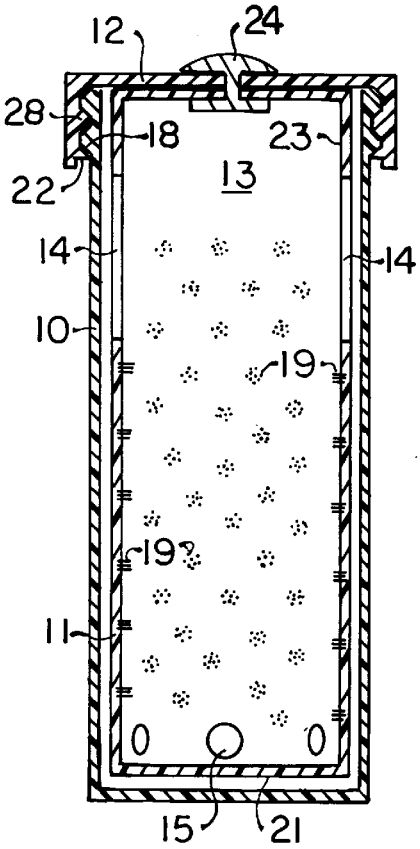
FIG. 3 is a cross sectional view of a second preferred embodiment of the principles relating to the present invention.

Other means of scrubbing disposed upon the interior surface 23 of the interior receptacle 13, though generally considered inferior to the fractures 17 of the first preferred embodiment of the principles relating to the present invention for the reasons given above, may readily be utilized in fulfillment of said principles. As seen in FIG. 3, a plurality of bristles 19, preferably arranged in a plurality of bunched groups of bristles 19 in order to more effectively clean the concavities of a dimpled surface golf ball and facilitate manufacture, is considered to provide a perfectly adequate means of scrubbing. This means is considered much more expensive in manufacture of the interior receptacle 13 than one made with the use of fractures 17 presenting inward broken edges 27. It is also considered more susceptible to wear through use and inherently less conducive to minimization of the diameter of the scrubbing chamber 13 required and hence of the overall dimensions of the device. Two upper apertures 14, preferably possessing a substantially round shape with a diameter slightly greater than a golf ball similar to that depicted in FIG. 1*a* are also depicted in FIG. 3.

Figure 4A:
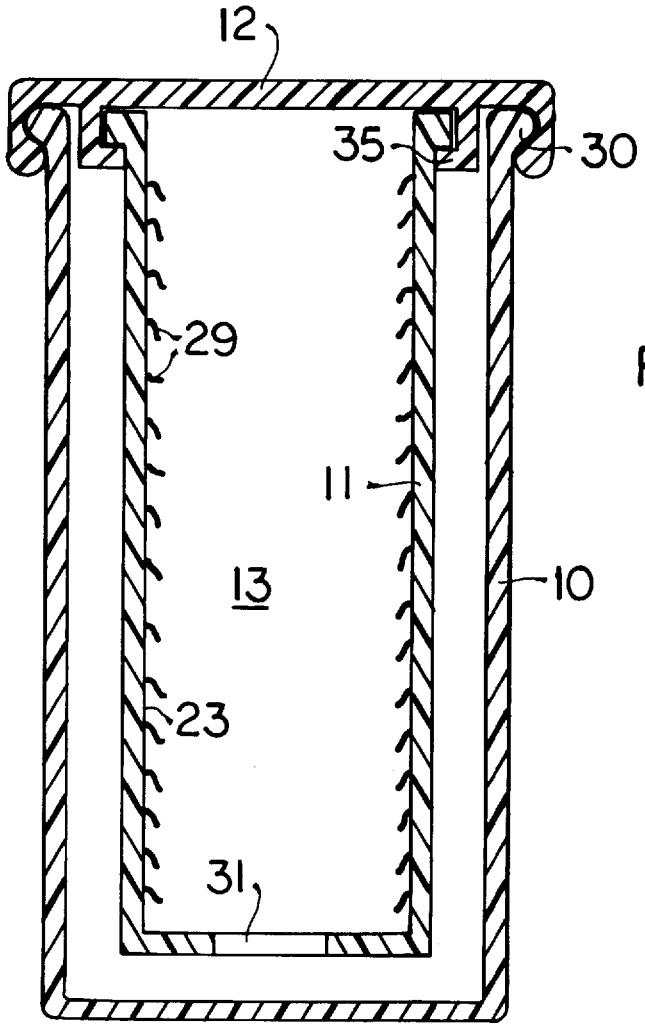
FIG. 4*a* is a cross sectional view of a third preferred embodiment of the principles relating to the present invention.
Figure 4B:
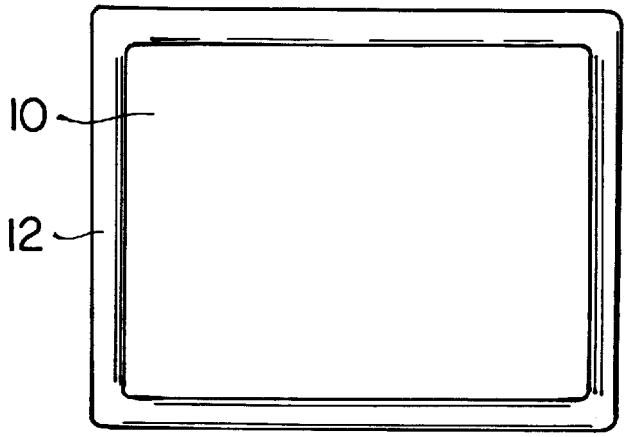
FIG. 4*b* is a plain elevational view taken from the bottom of the third preferred embodiment of the principles relating to the present invention depicted FIG. 4*b*.

A third preferred embodiment of the principles relating to the present invention is represented in FIGS. 4*a* & 4*b* which, in contrast to the first two preferred embodiments discussed above, possesses a generally rectangular outer shell 10 as seen in FIG. 4*b* and interior receptacle 11, a lid 12 which seals in resilient deformation in engagement with a lip 30 about the upper periphery of the outer container 10 defining the top opening 20 of the same. This type of closure is considered somewhat less satisfactory than the threading 18, 28 described above as a means of closure for reasons of durability and assurance of a water tight seal. The scrubbing means depicted in FIG. 4*a* is comprised of a plurality of flexible blades 29 such as found in artificial grass or outdoor carpeting. Another variation is given by the lack of a top aperture 14 and an easily removable connection between the lid 12 and the interior receptacle 11 provided by the use of flanges 35. The lid 12 in this case pulls off the outer container 10 with the interior receptacle 11 attached. The lid 12 and the interior receptacle 11 are separated by displacement of one relative the other as allowed by the flanges 35, the interior receptacle is inverted and the golf ball removed from the scrubbing chamber 13 through the now open mouth 40 of the interior receptacle 11.

Figure 5:
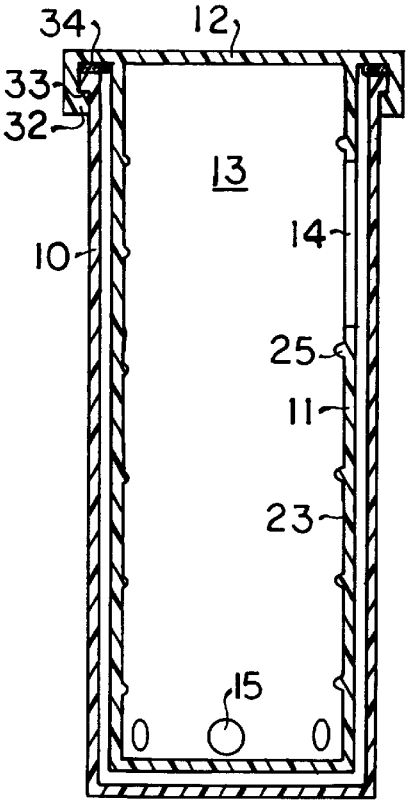
FIG. 5 is a cross sectional view of a fourth preferred embodiment of the principles relating to the present invention.

A fourth preferred embodiment of the principles relating to the present invention is depicted in FIG. 5 wherein an outer shell 10 and an interior receptacle 11 both of generally cylindrical shape similar to the first two preferred embodiments is utilized. Rather than using threading 18, 28 to obtain a sealed closure of the outer shell 10 with the associated lid 12, however, at least two lugs 32 each of which engage an anterior surface 33 of the outer container 10 perpendicular to the exterior sidewall of the same. A gasket 34 between the lid anterior 22 and the top edge of the outer shell 10 is compressed in closure. It is further seen in FIG. 5 that in this embodiment the lid 12 and the interior receptacle 11 are of one single piece, one upper aperture 14 is utilized and drain holes 15 through the sidewall of the interior receptacle 11 proximate the bottom of the same are employed. In this embodiment the scrubbing means employed is comprised of a plurality of solid projections 25 extending inward from the interior surface 23 of the interior receptacle 11 which bounds the scrubbing chamber 13. These solid projections 25 preferably possess an effective diameter and height from the interior surface 23 appropriate to the diameter and depth of the concavities forming the dimpling upon a modern golf ball.

Figure 6:
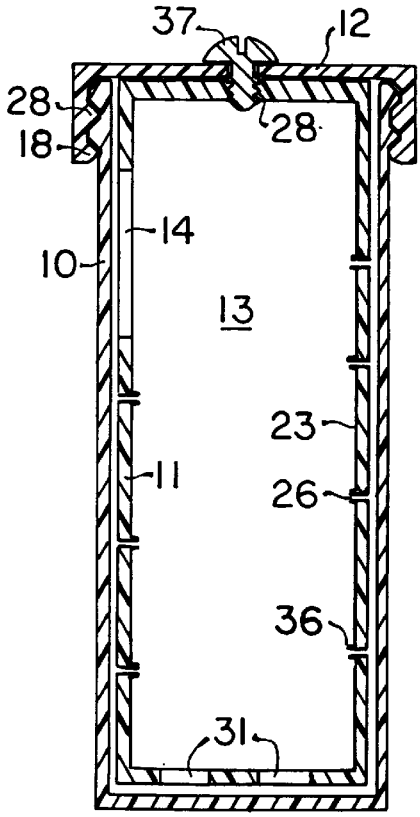
FIG. 6 is a cross sectional view of a fifth preferred embodiment of the principles relating to the present invention.

A fifth preferred embodiment of the principles relating to the present invention is depicted in FIG. 6. The outer shell 10 and interior receptacle 11 are both of generally cylindrical shape and utilize threading 18, 28 to obtain sealing in closure. And a single round upper aperture 14 through the sidewall of the interior receptacle 11 is also utilized. All these aspects are similar to the first preferred embodiment discussed above. In contrast to that embodiment, however, drainage is provided by a plurality of apertures 31 through the bottom 21 of the interior receptacle 11 which is removably attached to the lid 12 by means of a female threading 28 at the top of he interior receptacle 11 which mates with a bolt 37.

The scrubbing means utilized in this embodiment is, as clearly seen in FIG. 6, a plurality of perforations 26 each presenting a relatively uniform circular raised ridge 36 projecting inward from the substantially smooth, cylindrical, interior surface 23 of the interior receptacle 11 bounding the scrubbing chamber 13. Each perforation 26 preferably presents a raised ridge 36 which is of effective diameter and height from the interior surface 23 commensurate with the diameter and depth of the concavities upon the exterior surface of a modern golf ball. Each perforation 26, as seen in FIG. 6, includes an aperture through the sidewall of the interior receptacle 11 which provides communication between the scrubbing chamber 13 and the interior of the outer shell 10 external to the interior receptacle 11 disposed within the shell 10.

A perforation 26 is opposed to a fracture 17 in presenting a relatively uniform structure. The fracture 17 presents irregular broken edges 27 while the perforation 26 presents a comparatively uniform raised ridge 36. Both are the result of puncturing the sidewall of the interior receptacle 11 from the outside of the same. In producing a fracture 17, however, the puncture is unopposed by a congruent structure interior to the interior receptacle 11. In producing a perforation 26 the puncture is opposed by a congruent structure interior to the interior receptacle 11. Given construction in thermoplastic, which is generally preferred for all the embodiments of the principles relating to the present invention, an appropriately sized and shaped anvil disposed inside the interior receptacle 11 during puncturing by an appropriate tool will cause the portion of the sidewall affected to form a relatively uniform perforation 26 such as the structure depicted in FIG. 6.

Both of these scrubbing means are opposed to the solid projections 25 depicted in FIG. 5 which essentially requires molding of the interior receptacle 11 and essentially does not permit use of a conventional component. The use of a plurality of flexible blades 29 as depicted in FIG. 4 allows use of a conventional component but requires the addition of another component, as does the use of a plurality of bristles 19 as depicted in FIG. 3. Use of fractures 17 or perforations 26 is therefore preferred over bristles 19, flexible blades 29 or solid projections 25. A cylindrical shape for both the interior receptacle 11 and the outer shell 10 is preferred to any other and threading 18, 28 is preferred over other means of obtaining a seal in closure of the outer shell 10 with the lid 12. The other variations discussed herein are considered secondary and any further variation in details of construction are considered to be well within the competence of one practiced in the art.

The foregoing is considered exemplary with regard to what is considered instructive to one practiced in the art in obtaining what is considered the best manner of making and utilizing an embodiment in accordance with the principles relating to the present invention and is not to be considered in any manner restrictive of the scope of the subject matter encompassed by the property granted by Letters Patent for which I hereby claim:

1. A container intended for use as a portable cleaner of golf balls having a dimpled exterior surface possessing a plurality of similarly sized concavities, said container comprising:

a substantially rigid liquid impermeable outer shell, a lid removably fastenable to said outer shell, and a liquid permeable interior receptacle depending from said lid;

said outer shell possessing an exterior and an interior with an open mouth, said interior receptacle being fully removable from and disposable within said outer shell through said open mouth, said lid covering said mouth in removable fastening to said outer shell and sealing said container with said interior receptacle fully disposed within said outer shell;

said interior receptacle possessing a sidewall dependent from said lid, a bottom opposite said lid, an aperture proximate said lid through which a golf ball may pass, and an interior surface possessing a plurality of inward projections, each projection being capable of cleaning a concavity upon the exterior surface of a wet golf ball brought into contact with said projection, said interior surface defining a scrubbing chamber into which a golf ball may be disposed by passing the golf ball through said aperture and in which a golf ball may be reciprocally displaced with reciprocation of the sealed container with said interior receptacle fully disposed within said outer shell with said lid fastened, said interior receptacle further possessing at least one drain hole permitting fluid flow into and out of said scrubbing chamber during disposal and removal, respectively, of said interior receptacle into and from said outer shell;

whereby an appropriate amount of cleaning fluid may be placed in said container, a golf ball passed through said aperture into said scrubbing chamber, said interior receptacle disposed fully within said outer shell, said lid fastened to said outer shell, and manual reciprocation of the sealed container employed to reciprocally displace the golf ball within said scrubbing chamber thereby cleaning said golf ball after which removal of the cleaned golf ball without spillage of cleaning fluid held in the container may be effected with unfastening of said lid from said outer shell, removal of said interior receptacle from said outer shell, inversion and inclination of said interior receptacle facing said aperture downward permitting said golf ball passage therethrough.

2. A container in accordance with claim 1 wherein said plurality of inward projections from said interior surface of said interior receptacle is comprised of a plurality of groups of bristles.

3. A container in accordance with claim 1 wherein said plurality of inward projections from said interior surface of said interior receptacle is comprised of a plurality of flexible blades.

4. A container in accordance with claim 1 wherein said plurality of inward projections from said interior surface of said interior receptacle is comprised of a plurality of broken edges presented by a plurality of fractures of said sidewall of said interior receptacle.

5. A container in accordance with claim 1 wherein said plurality of inward projections from said interior surface of said interior receptacle is comprised of a plurality of solid projections from said sidewall.

6. A container in accordance with claim 1 wherein said plurality of inward projections from said interior surface of said interior receptacle is comprised of a plurality of raised ridges formed by an equal number of perforations of said interior receptacle.

7. A container in accordance with claim 1 wherein fastening of the lid to said outer shell is effected with female threading of said lid mating with male threading about the exterior of said outer shell proximate the open mouth of the outer shell.

8. A container in accordance with claim 1 wherein fastening of the lid to the outer shell is effected with resilient deformation of a periphery of said lid in engagement with a lip extending outward from the outer shell exterior proximate the open mouth of said outer shell.

9. A container in accordance with claim 1 wherein closure of the container is obtained with at least two lugs each engaging a surface perpendicular to said outer shell proximate the open mouth of said outer shell.

10. A container in accordance with claim 1 wherein said aperture proximate said lid is through said sidewall.

11. A container in accordance with claim 10 wherein said interior receptacle further possesses a second aperture through said sidewall.

12. A container in accordance with claim 1 wherein said interior receptacle is detachable from said lid and separation of the lid from the interior receptacle reveals said aperture of said interior receptacle.

13. A container in accordance with claim 1 wherein at least one said drain hole is located through said sidewall proximate said bottom of said interior receptacle.

14. A container in accordance with claim 1 wherein at least one said drain hole is located through said bottom of said interior receptacle.

15. A container in accordance with claim 1 wherein said interior receptacle is rigidly and relatively permanently attached to said lid with use of a rivet.

16. A container in accordance with claim 1 wherein said interior receptacle is rigidly and relatively removably attached to said lid with use of threading.

17. A container in accordance with claim 1 wherein said interior receptacle and said lid are constructed of one piece.

18. A container in accordance with claim 1 wherein said interior receptacle is rigidly and removably attached to said lid with the use of flanges allowing displacement of said interior receptacle with respect to said lid.

19. A container in accordance with claim 1 wherein said interior receptacle and said outer shell are each of substantially cylindrical shape.

20. A container in accordance with claim 1 wherein said interior receptacle, said lid, and said outer shell are each constructed in thermoplastic.

* * * * *